US005322456A

United States Patent [19]

Yagi et al.

[11] Patent Number: 5,322,456

[45] Date of Patent: Jun. 21, 1994

[54] CONNECTOR WITH TERMINAL RETAINER

[75] Inventors: Sakai Yagi; Masanori Tsuji; Motohisa Kashiyama; Takayoshi Endo, all of Shizuoka, Japan

[73] Assignee: Yazaki Corporation, Tokyo, Japan

[21] Appl. No.: 925,754

[22] Filed: Aug. 7, 1992

[30] Foreign Application Priority Data

Aug. 14, 1991 [JP] Japan ..... 3-064432[U]
Aug. 23, 1991 [JP] Japan ..... 3-211982

[51] Int. Cl.[5] ..... H01R 13/436
[52] U.S. Cl. ..... 439/595; 439/752
[58] Field of Search ..... 439/594, 595, 597-599, 439/752

[56] References Cited

U.S. PATENT DOCUMENTS 5,057,042 10/1991 Yamanashi et al. ..... 439/595
5,108,319 4/1992 Tsuji et al. ..... 439/595
5,123,866 6/1992 Endo et al. ..... 439/595
5,139,447 8/1992 Yoneda et al. ..... 439/595

FOREIGN PATENT DOCUMENTS 63-58470 4/1988 Japan .

*Primary Examiner*—Paula A. Bradley
*Attorney, Agent, or Firm*—Sughrue, Mion, Zinn, Macpeak & Seas

[57] ABSTRACT

In the present invention, a terminal retainer is mounted on a rear portion of a connector housing so as to move in a two-stage manner, that is, between a provisionally-connected condition and a completely-connected condition, and a metal terminal can be immediately withdrawn in the provisionally-connected condition and can be positively engaged with metal terminals. According to the present invention, flexible support pieces each having a terminal retaining projection having a tapered relief engagement surface for a metal terminal are provided on a terminal retainer. A provisionally-retaining projection for provisionally retaining the terminal retainer is provided at a connector housing. In the provisionally-connected condition of the terminal retainer, by pulling the metal terminal, the terminal retainer is retracted via the tapered relief engagement surfaces, and at the same time the flexible support piece is caused to slide onto the retaining projection to be disposed out of the path of movement of the metal terminal.

5 Claims, 14 Drawing Sheets

CONNECTOR WITH TERMINAL RETAINER

BACKGROUND OF THE INVENTION

This invention relates to a connector of the type in which a terminal retainer is connected to connection terminals, retainingly received in respective terminal receiving chambers of a connector housing, from the rear side of the terminal receiving chambers, thereby achieving a double retaining construction for retaining the connection terminals.

Referring to FIG. 21, in Unexamined Japanese Utility Model Application Publication Sho. 63-58470, a designates a connector housing, and b designates a terminal retainer. A housing locking arm c of the terminal retainer b is engaged with a provisionally engaging projection e of connector housing a in a provisionally engagement condition. After that, the terminal retainer b is further pushed to engage the housing locking arm with real engaging projection in a real engagement condition.

FIG. 22 is a showing a cross-sectional view of a condition of a temporally engagement between the connector housing a and the terminal retainer b. The terminal retainer b has a resilient terminal locking arm f. The resilient terminal locking arm f includes a bulged portion $f_1$ at a free end thereof. The bulged portion $f_1$ is positioned into each terminal accommodating chamber g. A metal terminal h connected with a wire w is inserted from a rear portion into each terminal accommodating chamber g with the bulged portion being pushed up by the metal terminal h through $a_1$ window of the connector housing a until the metal terminal is engaged with a resilient locking piece i. Then, the terminal retainer b moves into the real engaging position to position the bulged portion $f_1$ of the resilient terminal locking arm f into an end portion of an electric contact portion $h_1$ of the metal terminal h. As a result, the metal terminal is doubly locked as shown in FIG. 23.

As shown in FIG. 24, in the case of where the metal terminal h is incompletely inserted, when the terminal retainer moves into the real engaging position, the bulged portion of $f_1$ of the resilient terminal locking arm f abuts against the metal terminal h to forcedly move the terminal retainer b into a normal position where the terminal retainer b is engaged with the resilient locking piece i.

However, when it is necessary to exchange the metal terminal h, the terminal retainer b should be removed from the Connector housing a. Thus, the terminal remove operation is more complicated, and it is possible to lose the removed terminal retainer b.

SUMMARY OF THE INVENTION

With the foregoing in view, it is a first object of this invention to provide a connector with the terminal retainer which enables the metal terminal to be removed from the connector without removing the terminal retainer from the connector housing.

It is a second object of this invention to provide a construction in which when a metal terminal is to be withdrawn, the operation for retracting a terminal retainer can be omitted, and when the terminal retainer is to be retracted with the hand, a proper range of movement of the terminal retainer can be easily detected from the exterior, thereby preventing damage.

With the foregoing in view, it is a third object of this invention to provide a construction in which when a terminal retainer is shifted from a provisionally-connected condition to a completely-connected condition, flexible displaceable plates are forcibly driven to fully achieve the above-mentioned double retaining effect.

To achieve the first object, according to the present invention, there is provided a connector with a terminal retainer comprising: a connector housing having a terminal accommodating chamber block including a plurality of terminal accommodating chambers and openings defined in an axial direction of said chamber block; and a terminal retainer moved in a two-stage manner, that is, between a provisionally-connected condition and a completely-connected condition, wherein said terminal retainer moves along an outer side of a wall of said connector and includes resilient deflecting plates having terminal engagement projections in an inner side thereof, respectively, each terminal engagement projection is inserted from the opening of said block, whereby when the terminal retainer is connected to the connector housing in the provisionally-connected condition, each terminal engagement projection rides on a tapered projection provided on the terminal accommodating chamber block to dispose the terminal engagement projection out of a path of movement of the metal terminal.

To achieve the second object, according to the present invention, there is provided a connector with a terminal retainer comprising a connector housing having a plurality of terminal receiving chambers, and the terminal retainer mounted on a rear portion of said connector housing so as to move in a two-stage manner, that is, between a provisionally-connected condition and a completely-connected condition, wherein flexible support pieces each having a terminal retaining projection having a tapered relief engagement surface for a metal terminal are provided on said terminal retainer; a provisionally-retaining projection for provisionally retaining said terminal retainer is provided at said connector housing; in the provisionally-connected condition of said terminal retainer, by pulling said metal terminal, said terminal retainer is retracted via said tapered relief engagement surfaces, and at the same time said flexible support piece is caused to slide onto said retaining projection to be disposed out of the path of movement of the metal terminal.

Also, there is provided a connector with a terminal retainer comprising a connector housing having a plurality of terminal receiving chambers, and the terminal retainer mounted on a rear portion of said connector housing so as to move in a two-stage manner, that is, between a provisionally-connected condition and a completely-connected condition, wherein flexible support pieces for metal terminals are provided on said terminal retainer; a provisionally-retaining projection for provisionally retaining said terminal retainer is provided at said connector housing; when said terminal retainer is further moved rearwardly from the provisionally-connection condition, said flexible support piece slides onto said retaining projection to be disposed out of the path of movement of the metal terminal; and at the time of said rearward movement of said terminal retainer, a retaining piece on said terminal retainer is engaged with a withdrawal prevention projection on said connector housing after a small projection, formed on said terminal retainer for detection purposes, slides over an engagement portion of said connector housing.

To achieve the third object, according to the present invention, there is also provided a connector with a terminal retainer comprising a connector housing having a plurality of terminal receiving chambers, and the terminal retainer mounted on a rear portion of said connector housing so as to move in a two-stage manner, that is, between a provisionally-connected condition and a completely-connected condition, wherein flexible support pieces for metal terminals are provided on said terminal retainer; a flexible retaining piece for the metal terminal is provided at each of said terminal receiving chambers; in the provisionally-connected condition of said terminal retainer, said flexible support piece is placed on a push-up projection of said connector housing to be held out of a path of movement of the metal terminal within said terminal receiving chamber; and when said terminal retainer shifts to the completely-connected condition, a driven projection on said flexible support piece is engaged in a drive groove in said connector housing to forcibly drive said flexible support piece into engagement with the metal terminal.

When the metal terminal is to be withdrawn through the wire, the tapered relief engagement surface of the flexible support piece of the terminal retainer is driven in sliding contact with the metal terminal, and is disengaged from the metal terminal.

The small projection for detection purposes tells the condition of the operation through a touch transmitted to the hand when this small projection slides over the engagement portion of the connector housing.

Through the agency of the driven projection, the drive groove positively guides the flexible support piece to the position where this flexible support piece is engaged with the metal terminal.

DETAILED DESCRIPTION OF THE PREFERRED EMBODIMENTS

A first embodiment of the present invention is shown in FIGS. 12–15.

Figure 12:
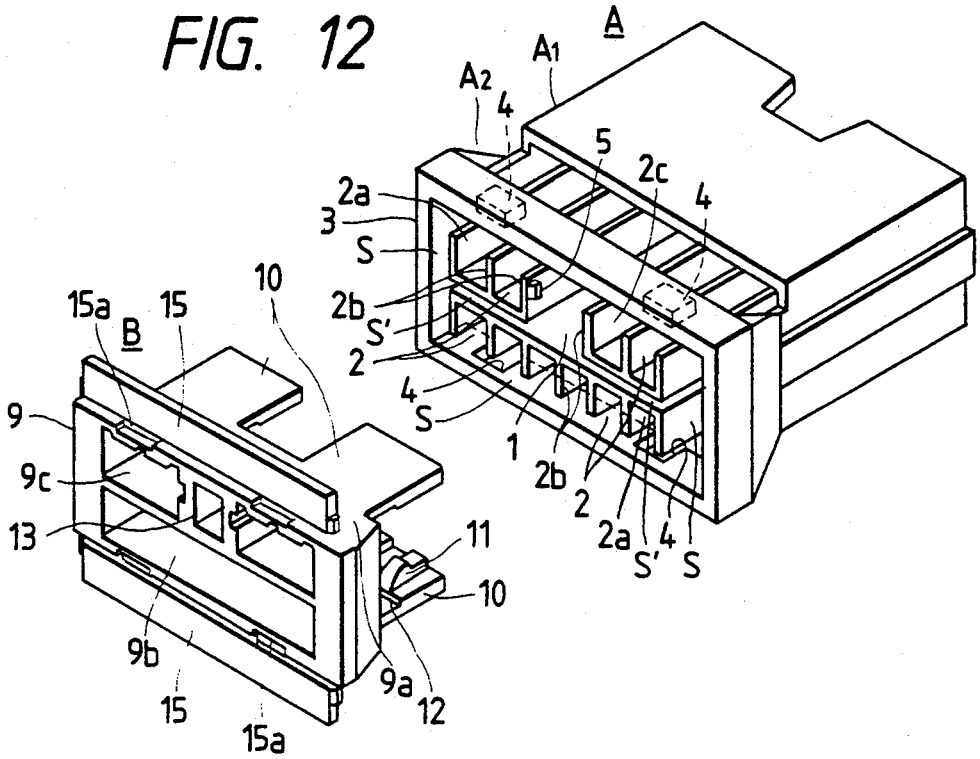
FIG. 12 is a cross-sectional view of a first embodiment of the present invention, showing a connector housing and a terminal retainer in a separated condition.
Figure 13:
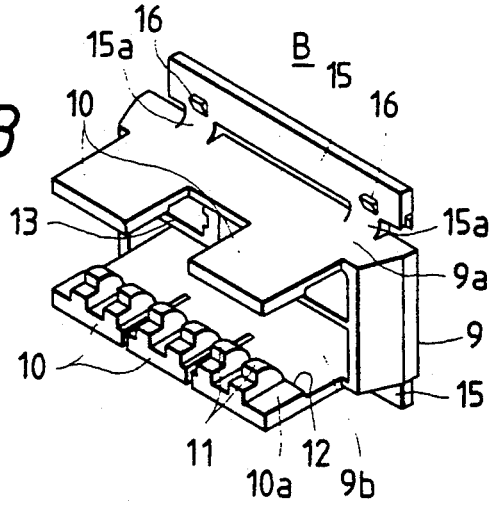
FIG. 13 is a perspective view of a terminal retainer of the first embodiment of the present invention.
Figure 14A:
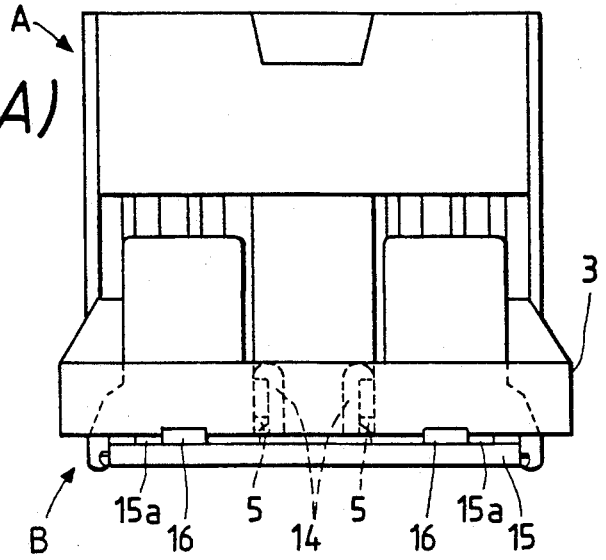
FIG. 14(A) is a plan view showing a provisionally-connected condition of the first embodiment.
Figure 14B:
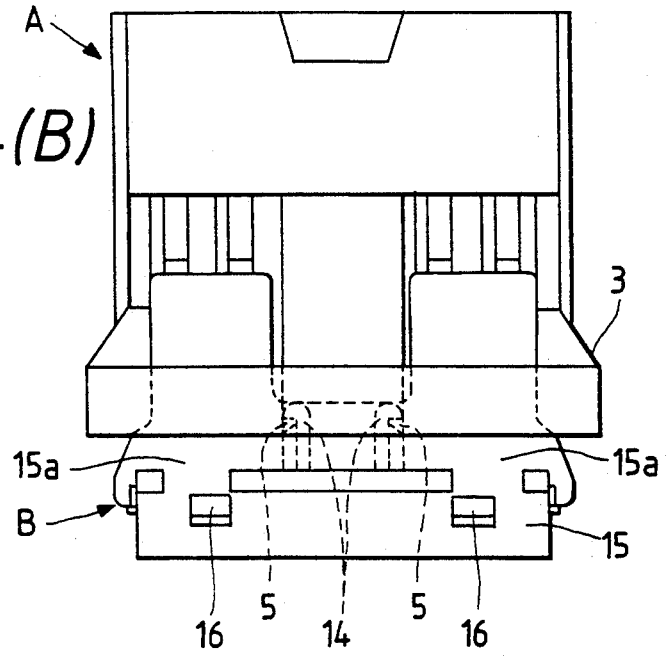
FIG. 14(B) is a plan view showing a disengaged condition of the terminal retainer of the first embodiment.

Referring to FIG. 12, each of a female-type connector housing A and a terminal retainer B is integrally molded of a synthetic resin.

The female-type connector housing A has a hood portion $A_1$ at its front half portion, and a group $A_2$ of terminal receiving chambers at its rear half portion. With respect to the terminal receiving chamber group $A_2$, four terminal receiving chambers 2 are juxtaposed at the upper stage, with a receiving space 1 provided at the central portion thereof. Six terminal receiving chambers 2 are juxtaposed at the lower stage. The terminal receiving chambers 2 at the upper stage have upwardly-directed open portions 2*a*, respectively, and the terminal receiving chambers 2 at the lower stage have downwardly-directed open portions 2*a*, respectively.

A hood 3 is provided around the periphery of the rear portion of the terminal receiving chamber group $A_2$, with an annular space S provided therebetween. Completely-retaining engagement portions 4 for the terminal retainer B are formed on the upper and lower portions of the hood 3 (see FIG. 15(B)). On the other hand, projections 5 for preventing the withdrawal of the terminal retainer B are formed respectively on partition walls 2*b* of the terminal receiving chambers 2 facing the receiving space 1. A gap S′ is formed between the terminal receiving chambers 2 of the upper stage and the terminal receiving chambers 2 of the lower stage.

Figure 15A:
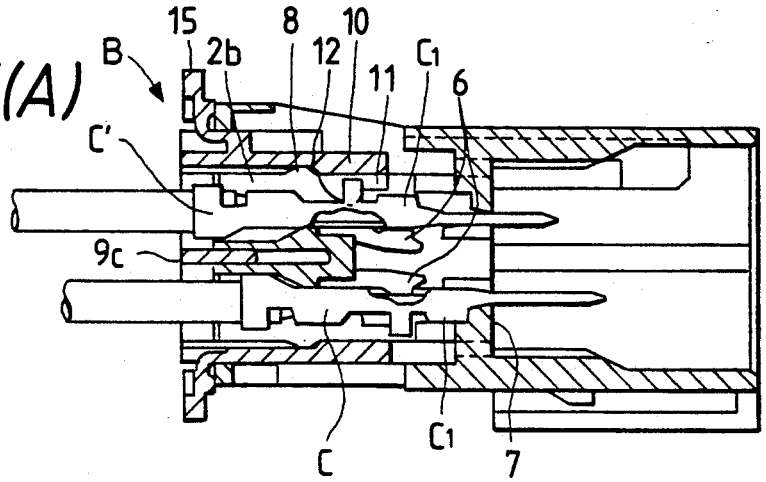
FIGS. 15(A), 15(B) and 15(C) are cross-sectional views showing the provisionally-connected condition, the completely-connected condition and the disengaged condition of the terminal retainer of the first embodiment, respectively.
Figure 15B:
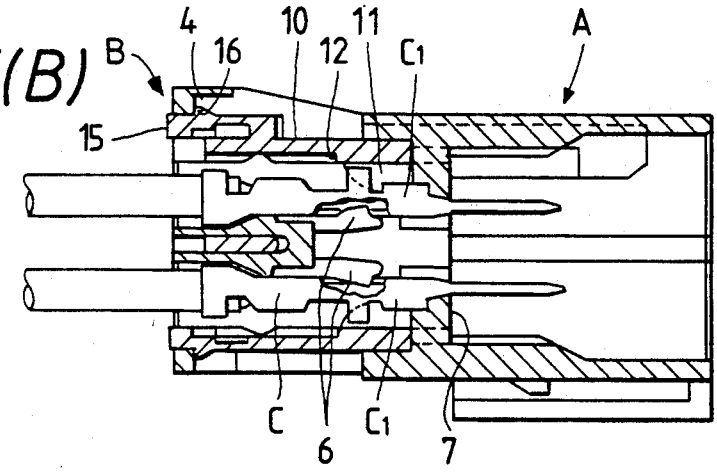
Figure 15C:
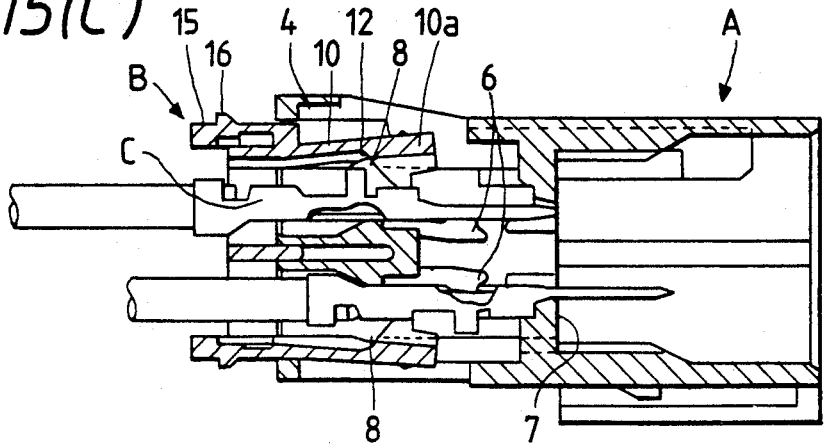

As shown in FIG. 15(A), a flexible support piece 6 which extends forwardly is formed on a bottom wall 2c of the terminal receiving chamber 2. The flexible support piece 6 serves as a primary retaining member for preventing the rearward withdrawal of a metal terminal C. A stopper wall 7 for the metal terminal C is formed at the front portion of the terminal receiving chamber 2. A triangle-shaped retaining projection 8 for provisionally-retaining purposes is formed on that edge of the partition wall 2b of the terminal receiving chamber 2 disposed close to the open portion 2a.

The terminal retainer B includes a main frame 9 having upper and lower plate portions 9a and 9b from which plate-like flexible support pieces 10 extend forwardly. One flexible support piece 10 is provided for two terminal receiving chambers 2, and therefore two flexible support pieces 10 are provided at the upper plate portion 9a in spaced relation to each other whereas three flexible support pieces 10 are provided at the lower plate portion 9b in continuous relation to one another.

Two terminal retaining projections 11 for two terminal receiving chambers 2 are formed on the inner surface of each flexible support piece 10, and a provisionally-retaining step 12 is also formed on the inner surface.

An intermediate plate portion 9c is formed in the main frame 9 of the terminal retainer B, and a fitting portion 13 for the receiving space 1 is formed between the upper plate portion 9a and the intermediate plate portion 9c. Retaining pieces 14 for the withdrawal prevention projections 5 are formed on the opposite sides of the fitting portion 13, respectively (see FIG. 14).

An engagement plate 15 is connected by a hinge portion 15a to the rear portion of each of the upper and lower plate portions 9a and 9b of the main frame 9, the engagement plate 15 being urged in an upstanding direction by the hinge portion 15a. Completely-retaining projections 16 for the completely-retaining engagement portions 4 are formed on the outer surface of the engagement plate 15.

In the above construction, the terminal retainer B is beforehand connected to the connector housing A in a provisionally-connected condition. In the provisionally-connected condition, the upper and lower flexible support pieces 10 of the terminal retainer B, as well as the upper and lower plate portions 9a and 9b, are inserted in the upper and lower portions of the annular space S, and also the intermediate plate portion 9c is inserted in the gap S'. The flexible support pieces 10 slide over the retaining projections 8 on the partition walls 2b, so that the provisionally-retaining steps 12 are engaged with the retaining projections 8, thereby achieving the provisionally-connected condition (see FIG. 15(A) and FIG. 14(A)).

In the provisionally-connected condition, the engagement plates 15 in the upstanding condition are abutted against the rear end of the hood 3 to prevent the terminal retainer B from accidentally moving into the interior, and the withdrawal prevention projections 5 are disengaged or spaced from their mating retaining pieces 14.

In the provisionally-connected condition, the metal terminals C are inserted into the terminal receiving chambers 2, respectively. At this time, an intermediate retaining portion $C_1$ of the metal terminal C is abutted against the terminal retaining projection 11 to displace the flexible support piece 10 outwardly via the open portion 2a, and then slides over the terminal retaining projection 11, and impinges on the stopper wall 7, and is engaged with the flexible retaining piece 6, thereby primarily retaining the metal terminal C against rearward withdrawal (FIG. 15(A)).

Then, the upstanding engagement plates 15 are laid flat, and the terminal retainer B is pushed into the connector housing A. At this time, the terminal retaining projection 11 on the flexible support piece 10 is abutted against the intermediate retaining portion $C_1$ of the incompletely-inserted metal terminal C' to drive this metal terminal into its completely-inserted position.

When the terminal retainer B is completely inserted into the connector housing A, there is achieved a completely-connected condition in which the completely-retaining projections 16 on the retaining plates 15 are engaged with the completely-retaining engagement portions 4 of the hood 3, respectively. In this condition, the terminal retaining projection 11 on the flexible support piece 10 is disposed close to the intermediate retaining portion $C_1$ to prevent the rearward withdrawal of the metal terminal C in a secondary manner (FIG. 15(B)).

When it becomes necessary to exchange the metal terminal C because of its breakage or the like, the completely-retaining projections 16 are disengaged from the completely-retaining engagement portions 4, respectively, and the terminal retainer is withdrawn until the retaining pieces 14 are brought into engagement with the withdrawal prevention projections 5, respectively, so that a thickened end portion 10a of the flexible support piece 10 slides onto the provisionally-retaining projection 8 to move the terminal retaining projection 11 outwardly out of the path of movement of the metal terminal C. In this condition, while releasing the engagement of the flexible retaining piece 6 by a jig (not shown), the metal terminal C is withdrawn (see FIGS. 15(C) and 14(B)).

Figure 16:
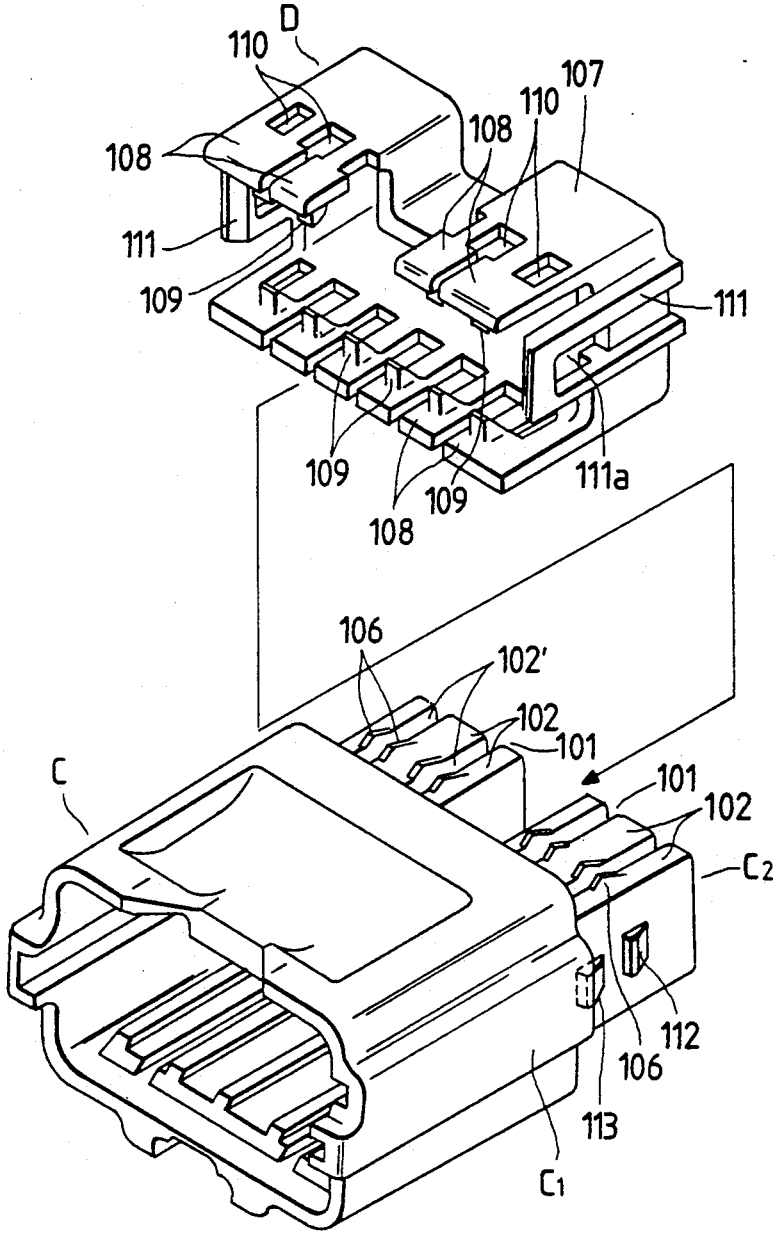
FIG. 16 is a perspective view of a second embodiment of the present invention showing a connector housing and a terminal retainer in a separated condition.

A second embodiment of the present invention is shown in FIGS. 16 and 17.

Referring to FIGS. 16 and 17, each of a connector housing C and a terminal retainer D is integrally molded of a synthetic resin.

The connector housing C has a hood portion $C_1$ at its front half portion, and a terminal receiving chamber block $C_2$ at its rear half portion with a peripheral wall removed.

Wall plates 102 are provided on opposite sides of each terminal receiving chamber 101, respectively, and the terminal receiving chamber 101 is open rearwardly and also upwardly (in the drawings) or downwardly (perpendicularly to the axis) as at 102' between the wall plates 102. Each terminal receiving chamber 101 has a flexible retaining piece 103 for a metal terminal G, and an intermediate partition wall 104 of the terminal receiving chamber has a terminal insertion hole 105 directed forwardly.

Push-up projections 106 are formed respectively on the edges of the wall plates 102, and are arranged in a row, the push-up projection 106 having a tapered surface extending in the front-to-rear direction.

A plurality of flexible displaceable plates 108, corresponding in arrangement to the terminal receiving chambers 101, are formed in a cantilever manner on upper and lower portions of a frame 107 of the terminal retainer D for receiving the terminal receiving chamber block $C_2$. A terminal retaining projection 109 is formed on the inner surface of the flexible displaceable plate 108, and relief notches 110 are formed rearwardly of the terminal retaining projections 109. When the terminal retainer D is to be connected to the connector housing C, the flexible displaceable plate 108 slides on the two wall plates 102 forming the terminal receiving chamber 101, and the terminal retaining projection 109 extends into the terminal receiving chamber 101.

Housing retaining arms 111 each having a retaining hole 111*a* are formed on and project forwardly from the opposite sides of the main frame 107 of the terminal retainer D, respectively. A provisionally-retaining projection 112 and a completely-retaining projection 113 for the housing retaining arm 111 are formed on the outer surface of each of the opposite-side wall plates 102 of the connector housing C, the two retaining projections 112 and 113 being spaced from each other in the front-to-rear direction.

Figure 17A:
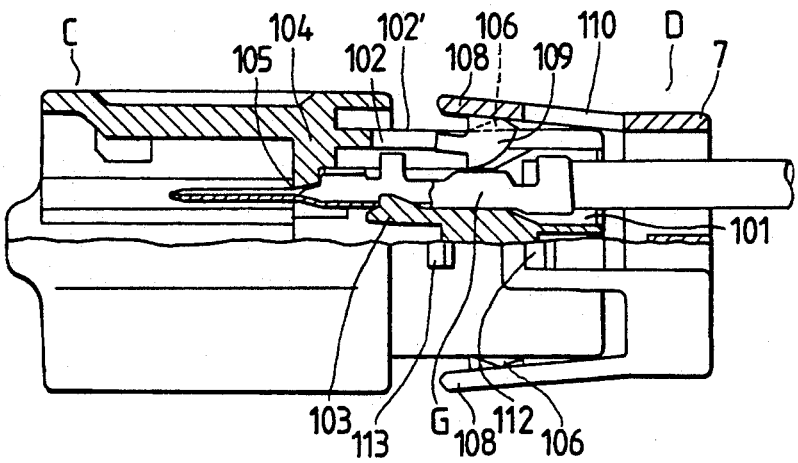
FIGS. 17(A), 17(B) and 17(C) are cross-sectional views of the second embodiment, showing a provisionally-connected condition, a transition to a completely-connected condition, and the completely-connected condition, respectively.

FIG. 17(A) is a cross-sectional view showing a provisionally-connected condition in which the housing retaining arms 111 of the terminal retainer D are engaged with the provisionally-retaining projections 112 of the connector housing C, respectively. In this case, the flexible displaceable plates 108 are placed on the respective push-up projections 106, so that each terminal retaining projection 109 is disposed out of the path of insertion of the metal terminal G within the terminal receiving chamber 101. Therefore, the metal terminal G can be smoothly inserted to be retained by the flexible retaining piece 103.

Figure 17B:
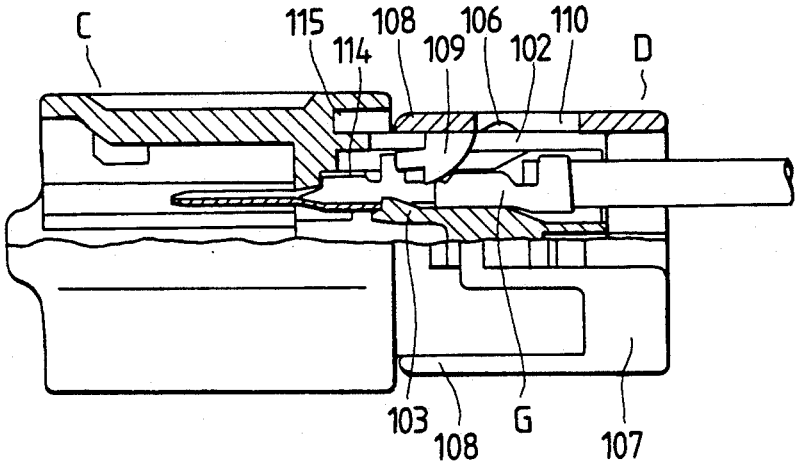
Figure 17C:
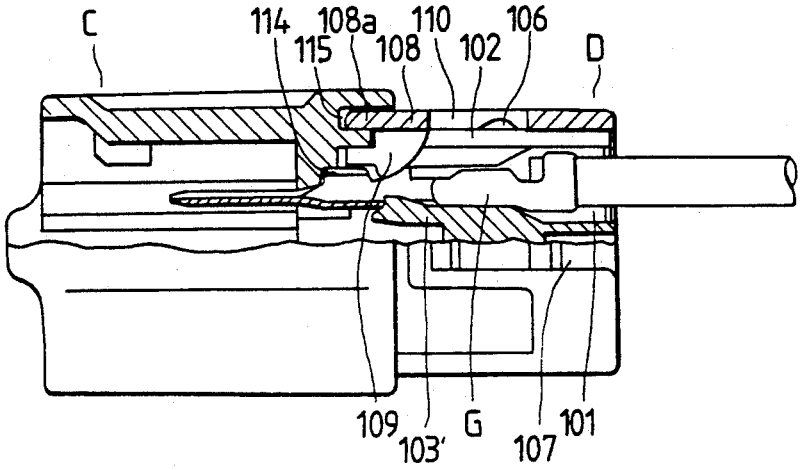

In this condition, when the terminal retainer D is slightly advanced, the push-up projections 106 are received in the respective relief notches 110, so that the flexible displaceable plates 108 are restored, and the terminal retaining projections 109 lie deep in the respective terminal receiving chambers 101 (FIG. 17(B)). Then, when the terminal retainer D is further advanced, the housing retaining arms 111 are engaged respectively with the completely-retaining projections 113 to achieve a completely-connected condition, in which case the terminal retaining projection 109 is disposed adjacent to the rear end of an intermediate portion 114 of the metal terminal G, thereby achieving a double lock of the metal terminal G (FIG. 17(C)). In the completely-connected condition, an end portion 108*a* of the flexible displaceable plate 108 is engaged in a recess 115 in the connector housing C, thereby preventing the flexible displaceable plate 108 from accidentally moving.

Third to fifth embodiments of the present invention, as described hereinbelow provides certain advantages over the first and second embodiment, giving attention to the following characteristics of the first and second embodiments.

In the first embodiment of the present invention, when it becomes necessary to exchange the metal terminal because of its damage, the terminal retainer is brought from the completely-retained condition into the provisionally-retained condition, and the terminal retainer is withdrawn, grasping the hingedly-connected engagement plate portions, so that the terminal retainer is brought into a position out of engagement with the metal terminals, and in this condition the metal terminal is detached. However, the hingedly-connected engagement plates are in a movable condition, and therefore can not easily be grasped, thus providing a poor operability, and besides an excessive force is exerted on the hinge portion, which results in a possibility that this hinge portion may be damaged.

Furthermore, when the terminal retainer is to be shifted from the completely-retained condition to the terminal-disengaged condition via the provisionally-retained condition, the degree of movement of the terminal retainer can not be detected from the exterior, and therefore there is a possibility that the withdrawal prevention portions may be damaged by the use of an undue force.

In the second embodiment of the present invention, when the terminal retainer is in the provisionally-connected condition for a long period of time, the flexibility of the flexible displaceable plate placed on the push-up projection is lowered, and this results in a possibility that when the terminal retainer is advanced to achieve the completely-connected condition, the terminal retaining projection may not be engaged with the metal terminal because of an inadequate restoring force of the flexible displaceable plate, thus failing to achieve the double retaining effect.

In a third embodiment of the present invention shown in FIGS. 1 to 7, a connector housing A of the female type has a hood portion $A_1$ at its front half portion, and a group $A_2$ of terminal receiving chambers at its rear half portion. A terminal retainer is designated at B'. Each of the connector housing and the terminal retainer is integrally molded of a synthetic resin. Most portions of the connector housing A and the terminal retainer B' are the same in construction as those of the conventional art shown in FIGS. 12 to 15, and are designated by identical reference numerals, respectively.

Figure 1:
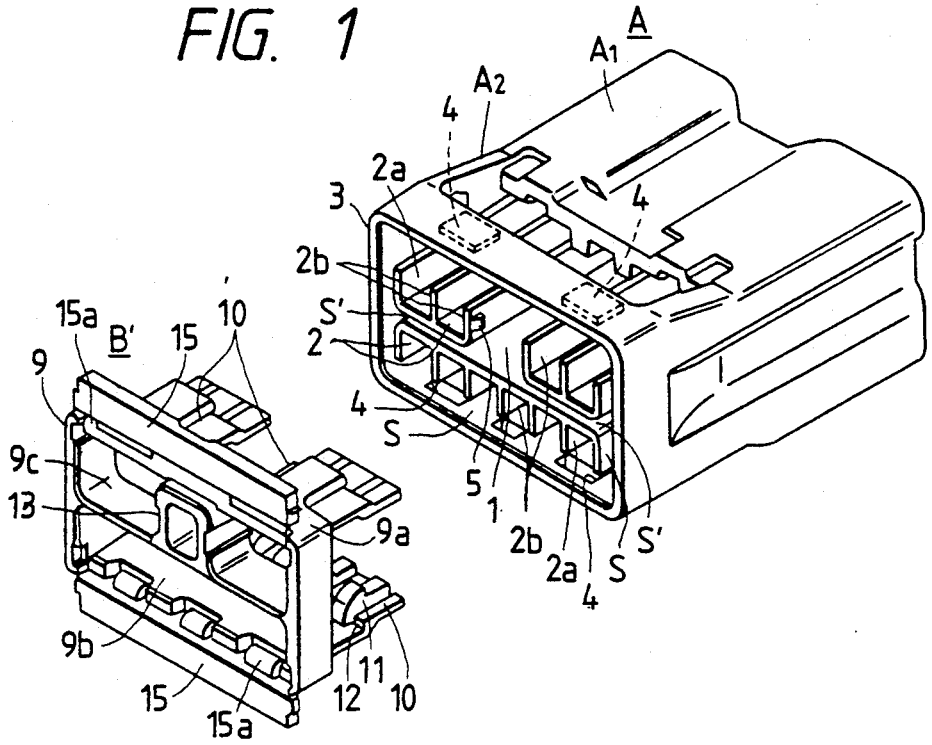
FIG. 1 is a perspective view of a third embodiment of the invention, showing a connector housing and a terminal retainer in a separated condition.
Figure 2:
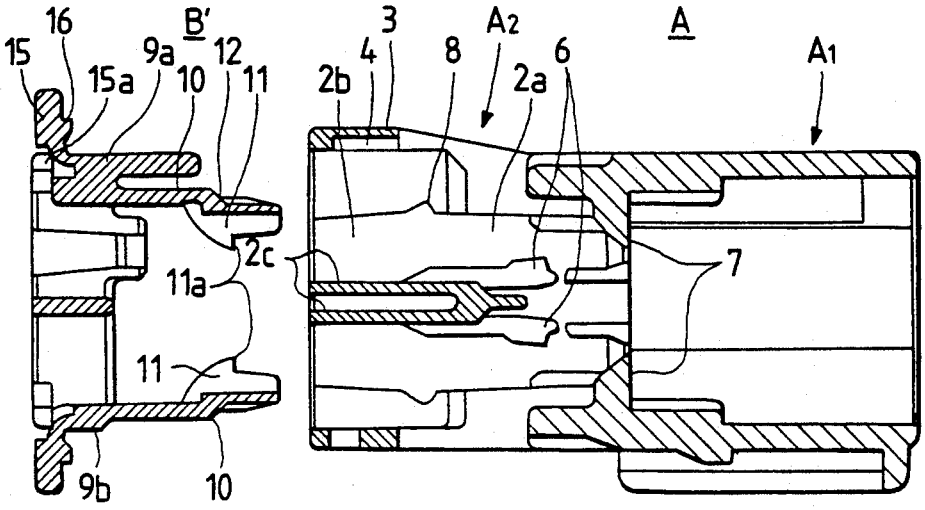
FIG. 2 is a cross-sectional view of the above embodiment.
Figure 3:
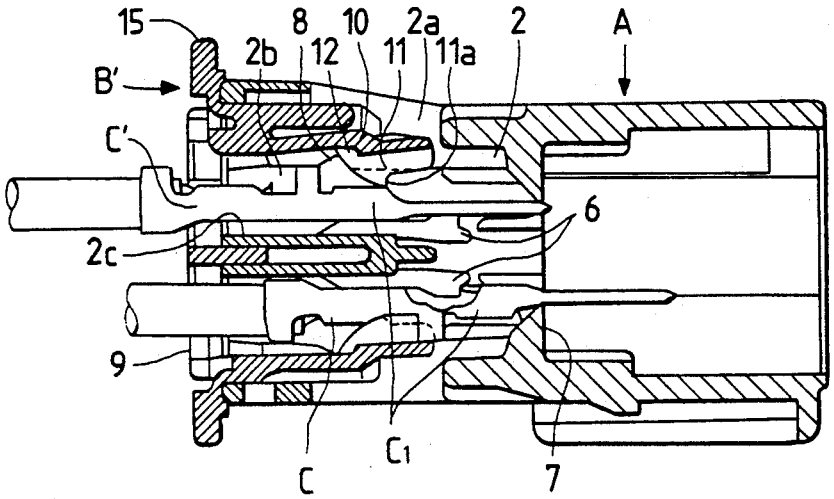
FIG. 3 is a cross-sectional view of the above embodiment in a provisionally-connected condition.

FIG. 3 shows a provisionally-connected condition in which the terminal retainer B' is provisionally connected to the connector housing A. In this condition, metal terminals C are inserted into the terminal receiving chambers 2, respectively. At this time, an intermediate retaining portion $C_1$ of the metal terminal C is abutted against a terminal retaining projection 11 to displace a flexible support piece 10 outwardly via an open portion 2*a*, and then slides over the terminal retaining projection 11, and impinges on a stopper wall 7, and is engaged with a flexible retaining piece 6, thereby primarily retaining the metal terminal C against rearward withdrawal.

Figure 4:
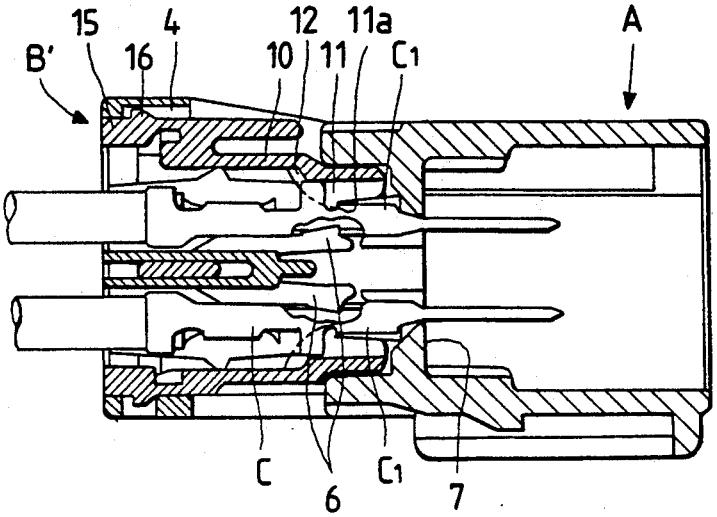
FIG. 4 is a cross-sectional view of the above embodiment in a completely-connected condition.
Figure 5:
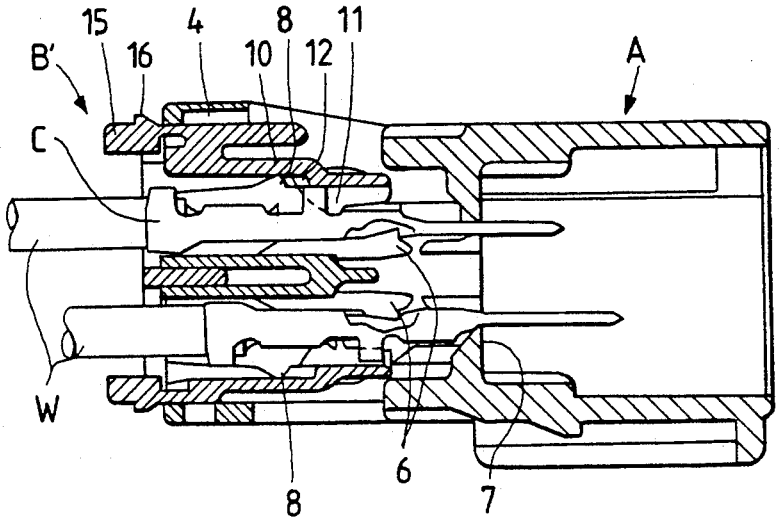
FIG. 5 is a cross-sectional view showing a condition in which the terminal retainer is withdrawn from the provisionally-connected condition.
Figure 6:
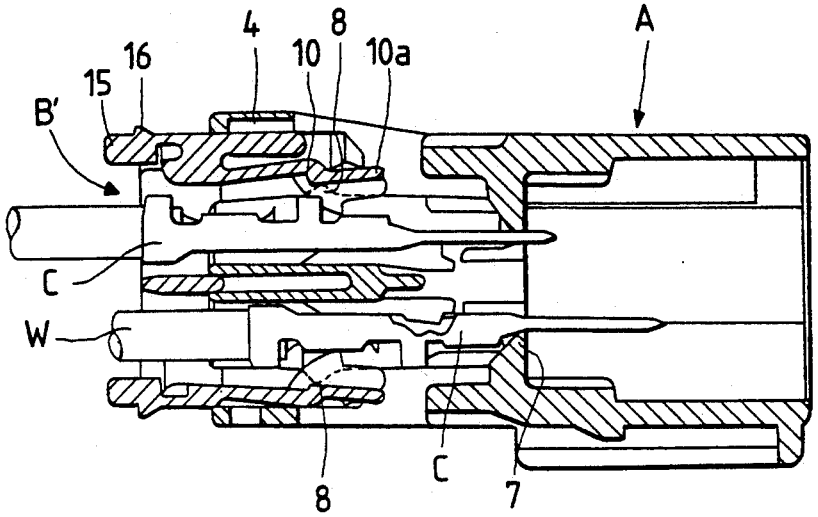
FIG. 6 is a cross-sectional view showing a condition in which a terminal is withdrawn in FIG. 5.
Figure 7A:
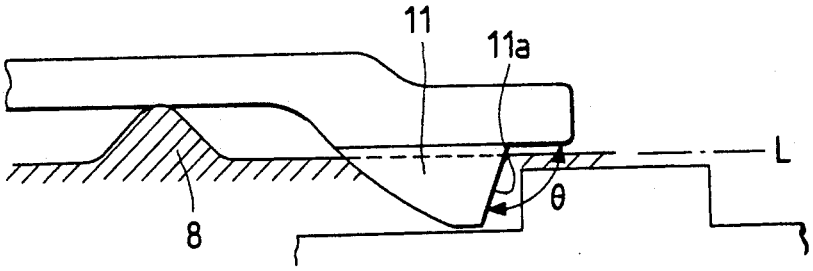
FIG. 7(A) is an enlarged view showing the condition of engagement between the metal terminal and a flexible support piece.
Figure 7B:
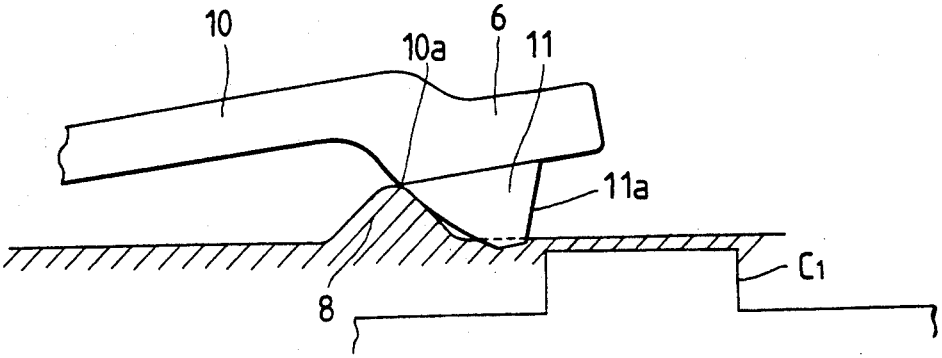
FIG. 7(B) is an enlarged view showing the operation of the flexible support piece when withdrawing the metal terminal.
Figure 8:
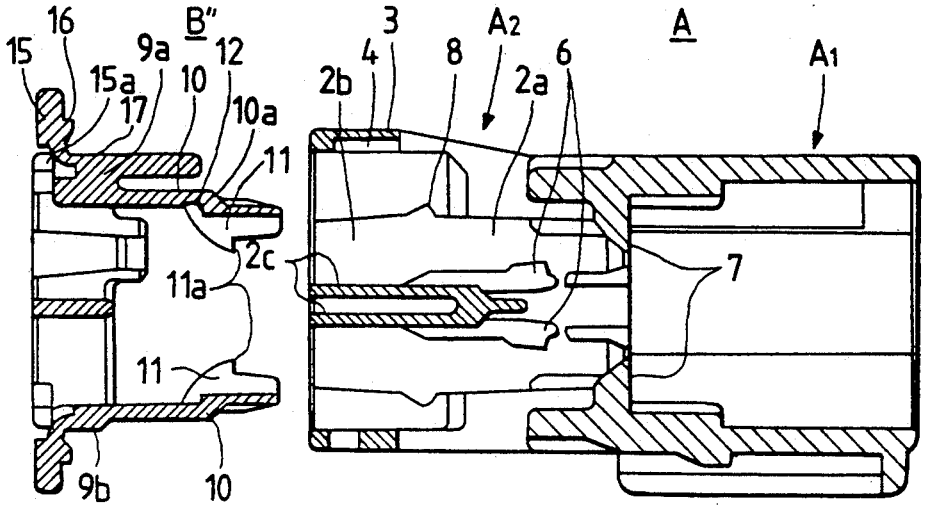
FIG. 8 is a cross-sectional view of a fourth embodiment of the invention, showing a connector housing and a terminal retainer in a separated condition.
Figure 9:
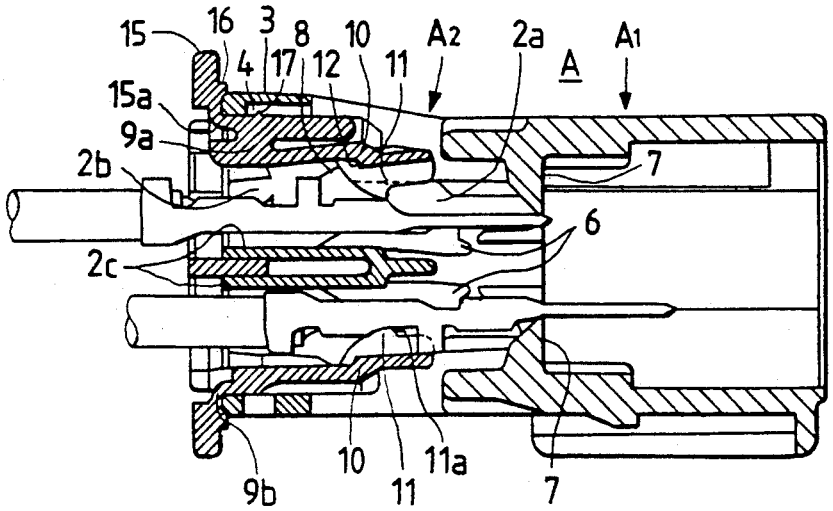
FIG. 9 is a cross-sectional view showing a provisionally-connected condition of the fourth embodiment.
Figure 10:
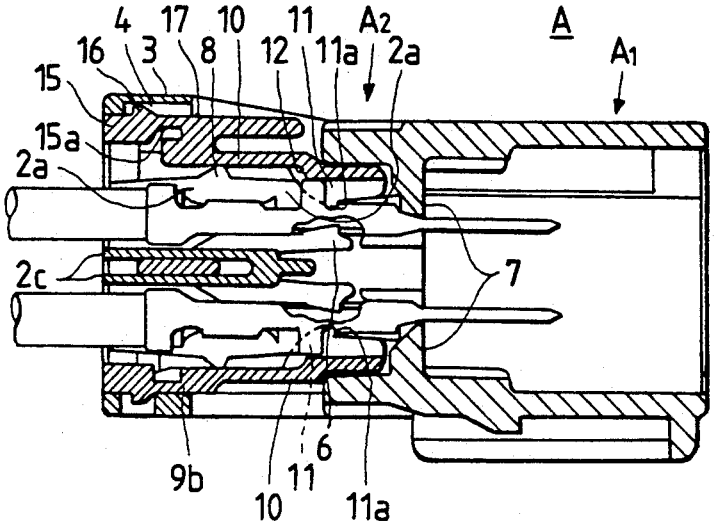
FIG. 10 is cross-sectional view showing a completely-connected condition of the fourth embodiment.
Figure 11:
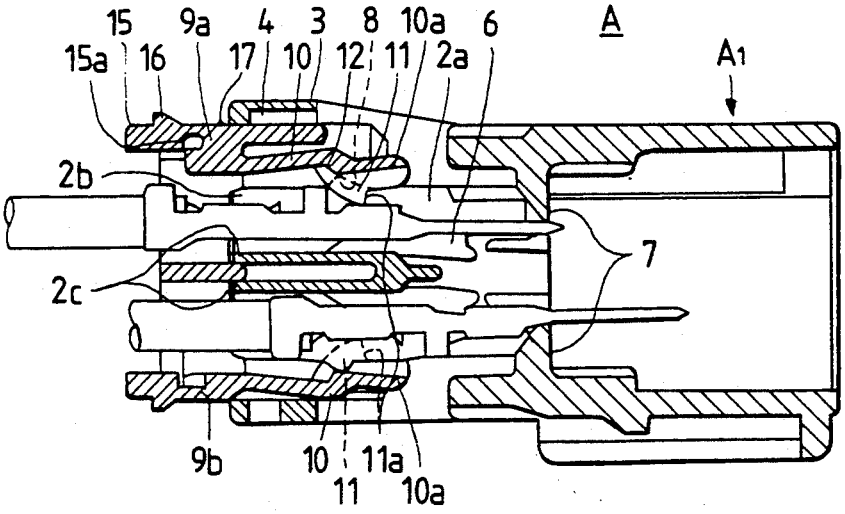
FIG. 11 is a cross-sectional view of the fourth embodiment, showing the condition of disengagement of a metal terminal.

Then, engagement plates 15 in an upstanding condition are laid flat, and the terminal retainer B' is pushed into the connector housing A, and completely-retaining projections 16 on the engagement plates 15 are engaged with completely-retaining engagement portions 4 to achieve a completely-connected condition, and the terminal retaining projection 11 on the flexible support piece 10 is disposed close to the intermediate retaining portion $C_1$, thereby achieving a secondary retaining of the metal terminal C against rearward withdrawal (FIG. 4). The terminal retaining projection 11 has at its front portion a tapered relief engagement surface 11*a*, the angle $\theta$ between this engagement surface 11*a* and an extension line L in the direction of the axis of the connector housing being not less than 120° (see FIG. 7).

When it becomes necessary to exchange the metal terminal C, the completely-retaining projections 16 are disengaged from the completely-retaining engagement portions 4, respectively, and the engagement of the flexible retaining piece 6 is released by a jig, and in this condition a wire W is pulled, so that the intermediate retaining portion $C_1$ of the metal terminal C retracts the terminal retainer B' via the tapered relief engagement surface 11*a* of the terminal retaining projection 11. Upon retraction of the terminal retainer B', a thickened end portion 10*a* of the flexible support piece 10 slides onto a provisionally-retaining projection 8 to be brought out of the path of movement of the metal terminal C, so that the metal terminal C can be immediately withdrawn. At this time, the tapered relief engagement surface 11*a* slides relative to the intermediate retaining portion $C_1$ so that it can be disengaged from the metal terminal C.

In a fourth embodiment of the present invention shown in FIGS. 8 to 11, most portions of a connector housing A and a terminal retainer B" are the same in construction as those of the conventional art shown in FIGS. 12 to 15, and are designated by identical reference numerals, respectively.

Small projections 17 for detection purposes are formed on an outer surface of an upper plate portion 9*a* of a main frame 229 of the terminal retainer B". In a provisionally-retained condition (FIG. 9) and a completely-retained condition (FIG. 10) of the terminal retainer B" with respect to the connector housing A, the small detection projections 17 are disposed at or near completely-retaining engagement portions 4 formed at a hood 3 of the connector housing A.

When it becomes necessary to exchange a metal terminal C, completely-retaining projections 16 are disengaged respectively from completely-retaining engagement portions 4, and in this condition the terminal retainer B" is withdrawn until retaining pieces 14 are engaged respectively with withdrawal prevention projections 5, so that a thickened end portion 10*a* of a flexible support piece 10 is caused to slide onto a provisionally-retaining projection 8 to move a terminal retaining projection 11 outwardly out of the path of movement of the metal terminal C. In this condition, while releasing the engagement of a flexible retaining piece 6 by a jig (not shown), the metal terminal C is withdrawn. At this time, the small detection projection 17 slides over the completely-retaining engagement portion 4 of the hood 3 before the retaining piece 14 is brought into engagement with the withdrawal prevention projection 5, and therefore from a touch transmitted to the hand at this time, it can be known that the terminal retainer B" shifts from the provisionally-retained condition to the condition for enabling the disengagement of the metal terminal.

Therefore, since the force for withdrawing the terminal retainer B" is weakened at this stage, the retaining piece 14 is prevented from strongly striking against the withdrawal prevention projection 5, thereby preventing damage to this withdrawal prevention portion.

Figure 18:
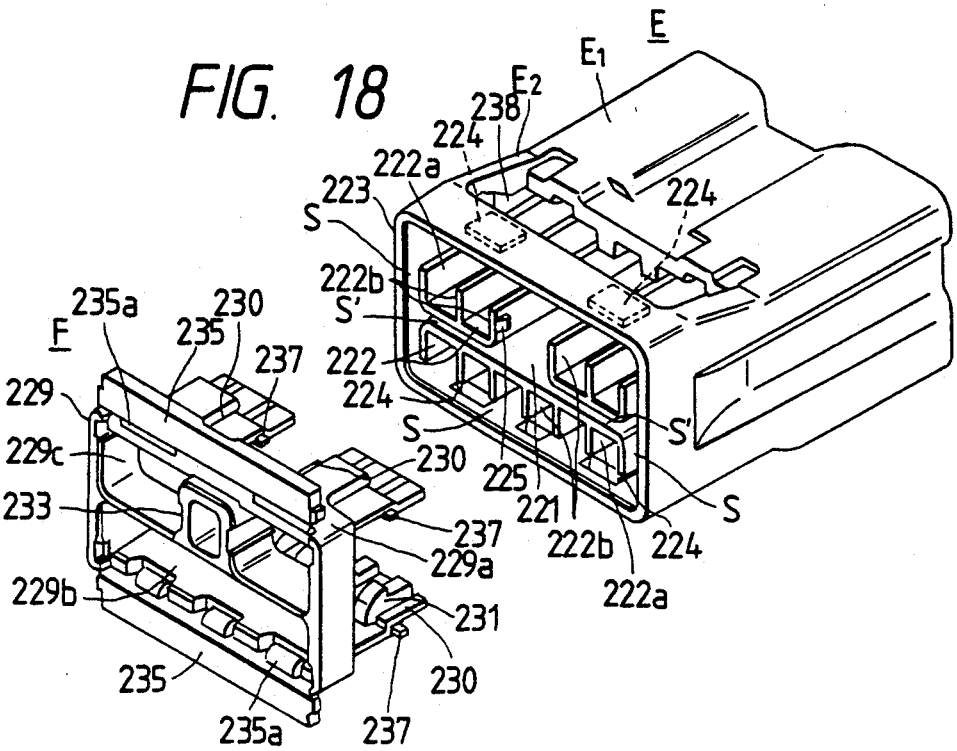
FIG. 18 is a perspective view of a fifth embodiment of the invention, showing a connector housing and a terminal retainer in a separated condition.
Figure 19:
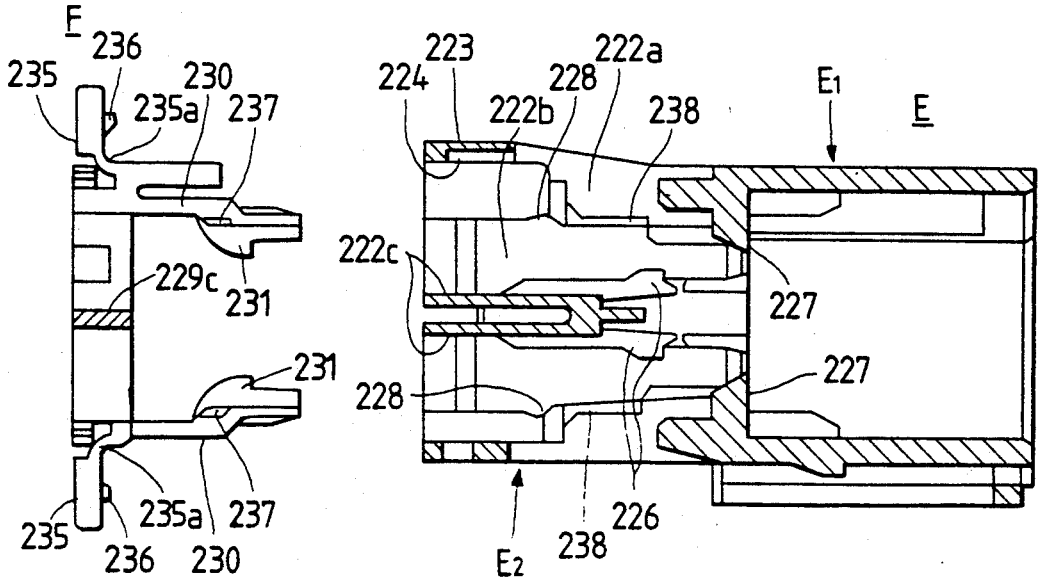
FIG. 19 is a cross-sectional view of the fifth embodiment.
Figure 20A:
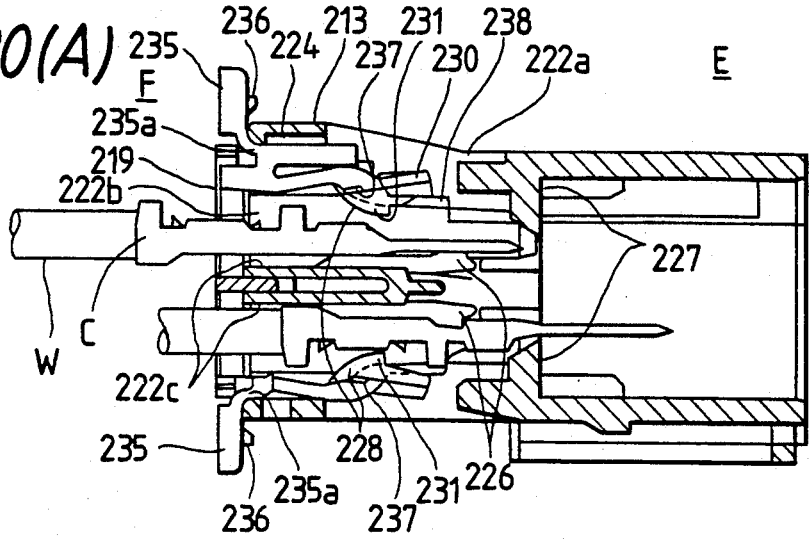
FIGS. 20(A), 20(B) and 20(C) are cross-sectional views of the fifth embodiment, showing a provisionally-connected condition, a completely-connected condition, and a terminal-disengaging condition, respectively.
Figure 20B:
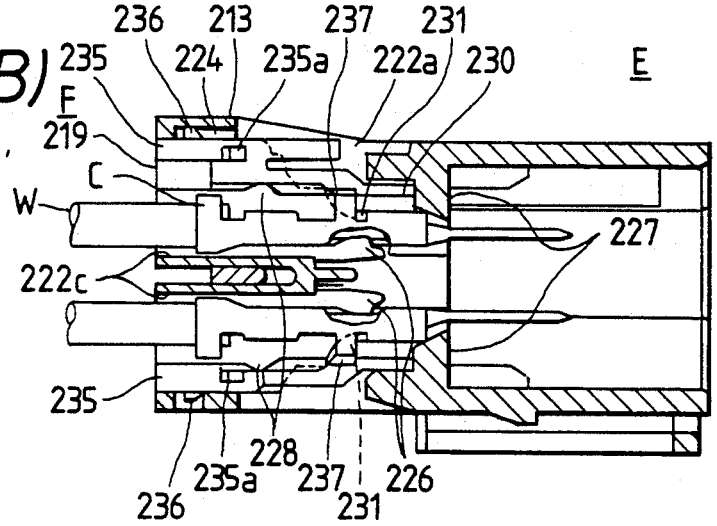

In a fifth embodiment of the present invention shown in FIGS. 18 to 20, each of a female-type connector housing E and a terminal retainer F is integrally molded of a synthetic resin.

The connector housing E of the female type has a hood portion $E_1$ at its front half portion, and a group $E_2$ of terminal receiving chambers at its rear half portion. With respect to the terminal receiving chamber group $E_2$, four terminal receiving chambers 222 are juxtaposed at the upper stage, with a receiving space 221 provided at the central portion thereof. Six terminal receiving chambers 222 are juxtaposed at the lower stage. The terminal receiving chambers 222 at the upper stage have upwardly-directed open portions 222*a*, respectively, and the terminal receiving chambers 222 at the lower stage have downwardly-directed open portions 222*a*, respectively.

A hood 223 is provided around the periphery of the rear portion of the terminal receiving chamber group $A_2$, with an annular space S provided therebetween. Completely-retaining engagement portions 224 for the terminal retainer F are formed on the upper and lower portions of the hood 223 (see FIG. 20). On the other hand, projections 225 for preventing the withdrawal of the terminal retainer F are formed respectively on partition walls 222*b* of the terminal receiving chambers 222 facing the receiving space 221. A gap S' is formed between the terminal receiving chambers 222 of the upper stage and the terminal receiving chamber 222 of the lower stage. Drive grooves 238 are formed in inner surfaces of side walls connecting the hood 223 to the hood portion $E_1$. As shown in FIG. 19, a flexible retaining piece 226 which extends forwardly is formed on a bottom wall 222*c* of the terminal receiving chamber 222. The flexible retaining piece 226 serves as a primary retaining member for preventing the rearward withdrawal of a metal terminal C. A stopper wall 227 for the metal terminal C is formed at the front portion of the terminal receiving chamber 222. A triangle-shaped push-up projection 228 having a tapered surface extending in the front-to-rear direction is formed on that edge of the partition wall 222*b* of the terminal receiving chamber 222 disposed close to the open portion 222*a*.

The terminal retainer F includes a main frame 229 having upper and lower plate portions 229*a* and 229*b* from which plate-like flexible support pieces 230 extend forwardly. One flexible support piece 230 is provided for two or three terminal receiving chambers 222.

A plurality of terminal retaining projections 231 corresponding in arrangement to the terminal receiving chambers 222 are formed on the inner surfaces of the flexible support pieces 230, respectively. Driven projections 237 are formed on the outside portions of the flexible support pieces 230.

An intermediate plate portion 229*c* is formed in the main frame 229 of the terminal retainer F, and a fitting portion 233 for the receiving space 221 is formed between the upper plate portion 229*a* and the intermediate plate portion 229*c*. Retaining pieces (not shown) for the withdrawal prevention projections 225 are formed on the opposite sides of the fitting portion 223, respectively.

An engagement plate 235 is connected by a hinge portion 235*a* to the rear portion of each of the upper and lower plate portions 229*a* and 229*b* of the main frame 9, the engagement plate 235 being normally urged in an upstanding direction by the hinge portion 235*a*. Completely-retaining projections 236 for the completely-retaining engagement portions 224 are formed on the outer surface of the engagement plate 235.

In the above construction, the terminal retainer F is beforehand connected to the connector housing E in a provisionally-connected condition. In the provisionally-connected condition, the upper and lower flexible support pieces 230 of the terminal retainer F, as well as the upper and lower plate portions 229*a* and 229*b*, are inserted in the upper and lower portions of the annular space S, and also the intermediate plate portion 229*c* is inserted in the gap S', and the flexible support pieces 230 is placed on the push-up projection 228 of the partition walls 222*b*, so that the terminal retaining projection 231 is disposed out of the path of insertion of the metal terminal C (FIG. 20(A)).

In the provisionally-connected condition, the engagement plates 235 in the upstanding condition are abutted against the rear end of the hood 223 to prevent the terminal retainer F from accidentally moving into the interior.

In the provisionally-connected condition, the metal terminals C are inserted into the terminal receiving chambers 222, respectively. At this time, since the terminal retaining projection 231 is disposed out of the path of movement, the metal terminal can be smoothly inserted, and the metal terminal impinges on the stopper wall 227, so that the metal terminal is primarily retained by the flexible retaining piece 226 against rearward withdrawal (FIG. 20(A)). Then, the upstanding engagement plates 235 are laid flat, and the terminal retainer F is pushed into the connector housing E, and the completely-retaining projections 236 of the engagement plates 235 are engaged with the completely-retaining engagement portions 224 of the hood 223, respectively, to thereby achieve a completely-connected condition. At this time, the driven projections 237 formed at the outside portions of the flexible support pieces 230 are engaged respectively in the drive grooves 238 formed in the inner surfaces of the side wall portions of the connector housing, and are guided by these drive grooves, so that the flexible support pieces 230 are forcibly driven in their restoring direction, and the terminal retaining projection 231 Of the flexible support piece 230 is disposed close to the intermediate retaining portion $C_1$ to thereby prevent the rearward withdrawal of the metal terminal C in a secondary manner (FIG. 20(B)).

Figure 20C:
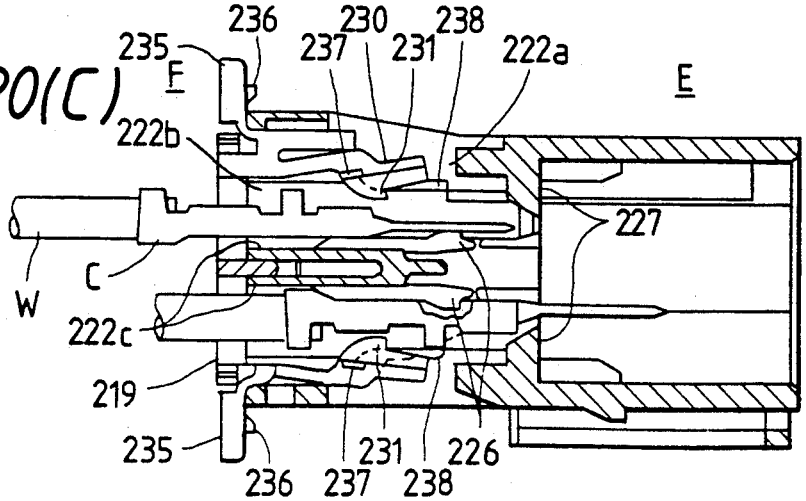
Figure 21:
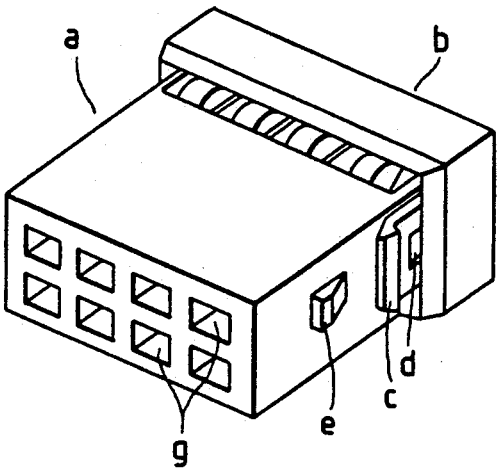
FIG. 21 PRIOR ART
FIG. 21 is a perspective view of a conventional connector housing with a terminal retainer.
Figure 22:
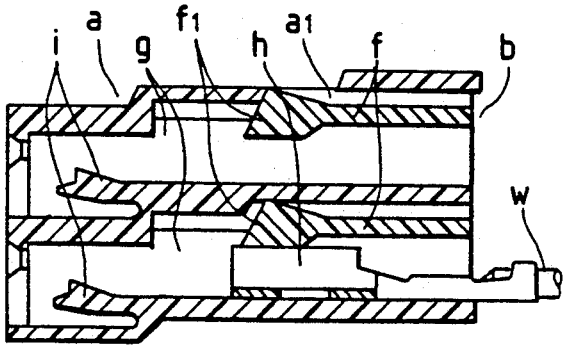
FIG. 22 PRIOR ART
FIG. 22 is a cross-sectional view of a provisionally connected condition of the conventional connector.
Figure 23:
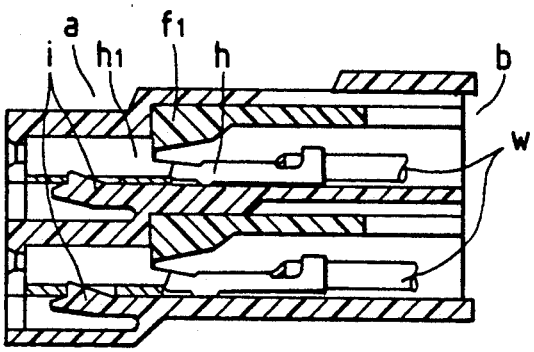
FIG. 23 PRIOR ART
FIG. 23 is a cross-sectional view of a completely connected condition of the conventional connector.
Figure 24:
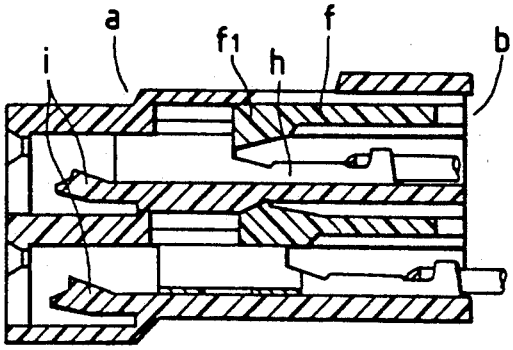
FIG. 24 PRIOR ART
FIG. 24 is a cross-sectional view of a metal terminal moving toward the completely connected condition.

When it becomes necessary to exchange the metal terminal C because of its breakage or the like, the completely-retaining projections 236 are disengaged from the completely-retaining engagement portions 224, respectively, and the terminal retainer F is returned to the provisionally-retained position, and the engagement of the flexible retaining piece 226 is released by a jig, and the metal terminal C is withdrawn through a wire W (FIG. 20(C)).

As described above, in the present invention, the connector comprises the connector housing having a plurality of terminal receiving chambers, and the terminal retainer mounted on the rear portion of the connector housing so as to move in a two-stage manner, that is, between the provisionally-connected condition and the completely-connected condition, wherein the flexible support pieces each having the terminal retaining projection having the tapered relief engagement surface for the metal terminal are provided on the terminal retainer; the provisionally-retaining projection for provisionally retaining the terminal retainer is provided at the connector housing; in the provisionally-connected condition of the terminal retainer, by pulling the metal terminal, the terminal retainer is retracted via the tapered relief engagement surfaces, and at the same time the flexible support piece is caused to slide onto the retaining projection to be disposed out of the path of movement of the metal terminal.

Therefore, by pulling the metal terminal immediately after releasing the completely-retained condition of the terminal retainer, the terminal retainer is retracted, and in this condition the metal terminal can be easily withdrawn.

Also, the connector comprises the connector housing having a plurality of terminal receiving chambers, and the terminal retainer mounted on the rear portion of the connector housing so as to move in a two-stage manner, that is, between the provisionally-connected condition and the completely-connected condition, wherein the flexible support pieces for the metal terminals are provided on the terminal retainer; the provisionally-retaining projection for provisionally retaining the terminal retainer is provided at the connector housing; when the terminal retainer is further moved rearwardly from the provisionally-connection condition, the flexible support piece slides onto the retaining projection to be disposed out of the path of movement of the metal terminal; and at the time of the rearward movement of the terminal retainer, the retaining piece on the terminal retainer is engaged with the withdrawal prevention projection on the connector housing after the small projection, formed on the terminal retainer for detection purposes, slides over the engagement portion of the connector housing.

Therefore, the withdrawal prevention mechanism is prevented from being damaged when the terminal retainer is retracted from its provisionally-retained condition relative to the connector housing.

As described above, in the present invention, the connector comprises the connector housing having a plurality of terminal receiving chambers, and the terminal retainer mounted on the rear portion of the connector housing so as to move in a two-stage manner, that is, between the provisionally-connected condition and the completely-connected condition, wherein the flexible support pieces for the metal terminals are provided on the terminal retainer; the flexible retaining piece for the metal terminal is provided at each of the terminal receiving chambers; in the provisionally-connected condition of the terminal retainer, the flexible support piece is placed on the push-up projection of the connector housing to be held out of a path of movement of the metal terminal within the terminal receiving chamber; and when the terminal retainer shifts to the completely-connected condition, the driven projection on the flexible support piece is engaged in the drive groove in the connector housing to forcibly drive the flexible support piece into engagement with the metal terminal.

Therefore, the flexible support piece, which is held out of the path of movement of the metal terminal in the provisionally-connected condition of the terminal retainer, can be positively engaged with the metal terminal in the completely-connected condition.

What is claimed is:

1. A connector comprising:

a connector housing having a plurality of terminal receiving chambers; and a terminal retainer mounted on a rear portion of said connector housing so as to be moveable between a provisionally connected condition and a completely connected condition, wherein said terminal retainer includes flexible support pieces each having a terminal retaining projection for retaining a metal terminal and said connector housing includes a provisionally retaining projection for provisionally retaining said terminal retainer, said terminal retaining projection having a tapered flank engagement surface.

2. A connector as claimed in claim 1, wherein said terminal retainer is retracted through said tapered flank engagement surface by pulling said metal terminal with said flexible support piece being caused to slide onto said provisionally retaining projection to be disposed out of a path of movement of said metal terminal.

3. A connector comprising:

a connector housing having a plurality of terminal receiving chambers; and a terminal retainer mounted on a rear portion of said connector housing so as to be moveable between a provisionally connected condition and a completely connected condition, wherein said terminal retainer includes flexible support pieces each having a terminal retaining projection for retaining a metal terminal and said connector housing includes a provisionally retaining projection for provisionally retaining said terminal retainer, and wherein when said terminal retainer is further moved rearwardly from said provisionally connected condition, said flexible support piece slides onto said provisionally retaining projection to be disposed out of a path of movement of said metal terminal and a retaining projection on said terminal retainer is engaged with a withdrawal prevention projection on said connector housing after said retaining projection, formed on said terminal retainer, slides past an engagement portion of said connector housing.

4. A connector comprising:

a connector housing having a plurality of terminal receiving chambers; and a terminal retainer mounted on a rear portion of said connector housing so as to be moveable between a provisionally connected condition and a completely connected condition, wherein said terminal retainer includes flexible support pieces for retaining metal terminals in said completely connected condition, wherein a flexible retaining piece for retaining said metal terminal is provided in each of said terminal receiving chambers, and wherein said flexible support piece includes a driven projection and said connector housing has a drive groove provided in a wall of each of said terminal receiving chambers, said projection being guided by said groove.

5. A connector as claimed in claim 4, wherein said flexible support piece is disposed on a push-up projection of said connector housing to be held out of a path of movement of said metal terminal within said terminal receiving chamber in said provisionally connected condition, and wherein when said terminal retainer shifts to said completely connected condition, said flexible support piece is forced into engagement with said metal terminal due to the engagement of said driven projection in said drive groove.

* * * * *